US005625352A

United States Patent [19]

Klemm et al.

[11] Patent Number: 5,625,352

[45] Date of Patent: Apr. 29, 1997

[54] METHOD AND ARRANGEMENT FOR TRANSMITTING DATA, SIGNALS AND ENERGY

[75] Inventors: Peter Klemm, Stuttgart; Burkhard Schumann, Ottenbach; Hilmar Rudloff, Koengen, all of Germany

[73] Assignee: Schuler Pressen GmbH & Co., Goeppingen, Germany

[21] Appl. No.: 443,409

[22] Filed: May 17, 1995

[30] Foreign Application Priority Data

Apr. 20, 1994 [DE] Germany ..... 44 13 789.3

[51] Int. Cl.[6] ..... G08C 14/16

[52] U.S. Cl. ..... 340/870.01; 340/870.32; 340/870.37; 340/870.31

[58] Field of Search ..... 340/870.01, 870.25, 340/870.31, 870.37, 870.32; 73/6, 27

[56] References Cited

U.S. PATENT DOCUMENTS

| | | | |
|---|---|---|---|
| 4,242,666 | 12/1980 | Reschovsky et al. | 340/870.28 |
| 4,837,556 | 6/1989 | Matsushita | 340/531 |
| 5,247,261 | 9/1993 | Gershenfeld | 340/870.37 |
| 5,437,058 | 7/1995 | Grosz | 340/870.31 |
| 5,473,323 | 12/1995 | Kreft | 340/870.31 |
| 5,491,468 | 2/1996 | Everett | 340/572 |

FOREIGN PATENT DOCUMENTS

| | | |
|---|---|---|
| 0388792A1 | 9/1990 | European Pat. Off. . |
| 0525459A1 | 2/1993 | European Pat. Off. . |
| 0530612A1 | 3/1993 | European Pat. Off. . |
| 2752418 | 12/1978 | Germany . |

*Primary Examiner*—Jeffery Hofsass
*Assistant Examiner*—Albert K. Wong
*Attorney, Agent, or Firm*—Evenson, McKeown, Edwards & Lenahan, P.L.L.C.

[57] ABSTRACT

A method and an arrangement are used for transmitting data, signals and/or energy from stationary parts in or on metal-forming machines, particularly presses and/or stamping machines, or the environment to at least one sliding table and/or the transfer system of the metal-forming machine. For this purpose, a stationary device is provided as well as a movable device which complements the stationary device. The stationary device comprises at least one transmitter, a first coupler, a coupling loop, and a first antenna. The movable device, in each case, has at least one second transmitter and a second antenna. The stationary device and/or the movable device are arranged on base plates in this case.

12 Claims, 4 Drawing Sheets

METHOD AND ARRANGEMENT FOR TRANSMITTING DATA, SIGNALS AND ENERGY

BACKGROUND AND SUMMARY OF THE INVENTION

The present invention relates to an arrangement for transmitting data, signals and/or energy, and more particularly to a method and arrangement for transmission from stationary parts in or on metal-forming machines, such as presses and/or stamping machines, or the environment to at least one sliding table and/or a feeding device for blanks and/or the transfer device of a metal-forming machine.

It is known from practice to carry out the supply of electric energy and the control-related coupling of moving machine parts and/or machine units on metal-forming machines by cables and control lines which, for example, are laid in trailing cables or are suspended as cable pendulums.

For transmitting energy to moving machine parts and/or machine units, sliding contacts are also used.

If the coupling to the moving machine unit or the machine part, for example, a sliding table and/or the transfer device of the metal-forming machine and/or a feeding or moving device for blanks is required only temporarily or in defined unchanged positions, it is carried out by contacting plug-type connections or a face contacting. Since the moving machine parts and/or machine units are often equipped with a plurality of electric sensors or actuators which, on the one hand, require a feeding of electric energy and, on the other hand, require a coupling of the electric input and output signals to the machine control, the known devices for transmitting electric energy and for the control-related coupling have many disadvantages.

These disadvantages include the wear of cables, of cable drag chains as well as of the contacts on slip rings or on the face contacting or on similar contacting connection devices.

This results in the necessity of a preventive exchange of the mentioned devices which results in relatively high maintenance and control expenditures and in a reduction of the availability of the metal-forming machines.

Another disadvantage of the known arrangements is the requirement of a mechanical precise positioning and guiding of the docking devices which receive the connectors.

Furthermore, the required installation space for the described arrangements is relatively large so that the metal-forming machine, on the whole, has to have dimensions which are larger than those which would actually be required.

It is therefore an object of the present invention to provide a method for transmitting data, signals and energy on the sliding table and/or the transfer device of a metal-forming machine which does not have the above-mentioned disadvantages; in particular, which is free of wear and results in relatively low maintenance and control expenditures.

According to the invention, this object is achieved by non-contact transmission of data, signals and/or energy.

Because of the no-contact transmission to the above-mentioned moving machine parts and/or machine units, there is no wear of cables and/or cable guiding devices, such as cable drag chains, the maintenance expenditures are clearly reduced, and it is not necessary to carry out a preventive exchange of the transmission devices so that the method according to the present invention is reasonable with respect to cost.

An arrangement for implementing the novel method includes a stationary device and a movable device which is configured to complement the stationary device, the stationary device comprising at least one transmitter, a first coupler, a coupling loop and a first antenna, and the movable device comprising at least one second transmitter and a second antenna, wherein at least one of the stationary device and the movable device is mounted on base plates, one base plate being mounted on a machine part or the environment, and the other base plate being mounted on a component linearly displaceable relative to the first base plate.

By mounting the stationary device and/or the movable device on base plates, the stationary device as well as the movable device may be prefabricated as an entire subassembly and may then be mounted at a desired point on the metal-forming machine.

BRIEF DESCRIPTION OF THE DRAWINGS

These and other objects, features and advantages of the present invention will become more readily apparent from the following detailed description thereof when taken in conjunction with the accompanying drawings wherein.

DETAILED DESCRIPTION OF THE DRAWINGS

Figure 1:
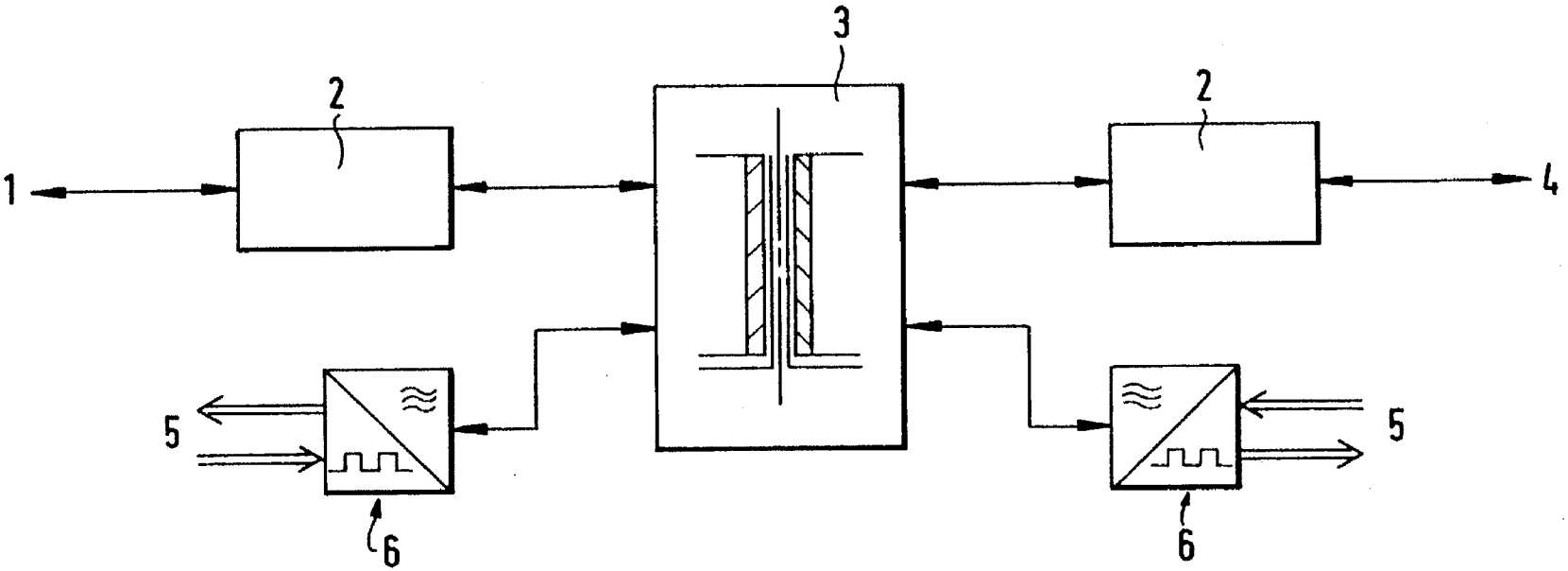
FIG. 1 is a schematic view of the no-contact transmission of data, signals and/or energy used in the present invention.

From an energy source or an energy sink 1 shown in FIG. 1, the energy is transmitted into a frequency converter 2 which transmits the energy 2 to a transmission system 3. In the transmission system 3, the transmitting of the energy takes place in a no-contact manner, after which the transmitted energy is forwarded to another frequency converter 2 which then transmits the energy to a conventional consuming device 4 which is not shown. The no-contact transmission of data and signals basically takes place in the same manner. From a data source or data sink 5, the data and/or signals are transmitted to a modulator/demodulator, in which case the data are then forwarded to the transmission system 3 in the form of an alternating voltage.

In the transmission system 3, the no-contact data transmission takes place, after which the data are forwarded to another modulator/demodulator 6 in which the data are converted back to the original signal form. From the second modulator/demodulator 6, the data and/or signals are again forwarded to a data source or data sink 5.

The entire operation, i.e., the energy transmission as well as the transmission of data and signals, may take place in a unidirectional manner or, as indicated in FIG. 1 by the double headed arrows, in a bidirectional manner.

The described method is known per se, but it has not been used in the case of metal-forming machines, more precisely, in the case of sliding tables and/or transfer devices on metal-forming machines.

Figure 2:
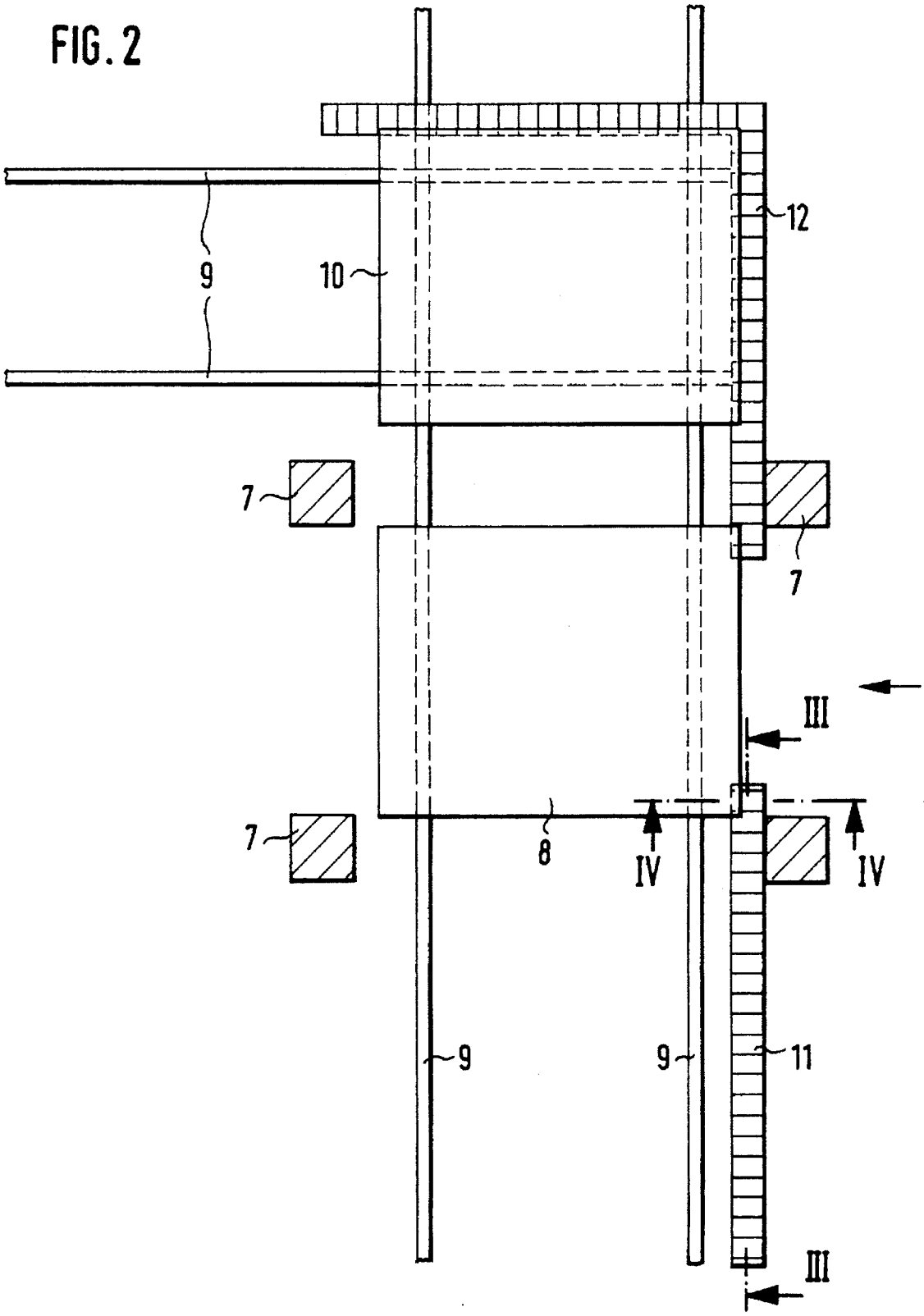
FIG. 2 is a schematic top view of a metal-forming machine of a first embodiment of the present invention embodying the no-contact transmission principle of FIG. 1.

The possibility of the unidirectional as well as of the bidirectional transmission of data, signals and energy also exists in the case of the first embodiment illustrated in FIG. 2 in which only the press stands 7 of the metal-forming machine are illustrated. A sliding table 8 is arranged between the press stands 7.

The sliding table 8 can be moved in a linear manner on rails 9, in which case the second sliding table 10 shown in FIG. 2 can also be moved in a rectangular manner.

As a result, it is achieved that, below the second sliding table 10, two wheel sets are arranged which are independent from one another, the first wheel set being arranged to be offset at an angle of 90° with respect to the other wheel set.

The arrangement of the rails 9 illustrated in FIG. 2, thus the rectangular arrangement of two rail paths, is called a "T-track".

In addition to the rails 9, mounting spaces 11, 12 for arrangements for the no-contact transmission of data, signals and energy are provided.

The mounting spaces 11, 12, and therefore also the arrangements arranged in the mounting spaces 11, 12, extend parallel to the rails 9.

As a result, it is ensured that the sliding tables 8, 10 can be supplied with energy, data and signals at any time; and data, signals and energy from the sliding tables 8, 10 can be transmitted again to stationary control units or the energy supply of the press.

The mounting spaces 11, 12 are preferably sunk into the ground so that the space existing next to the press is available for other purposes. Furthermore, as a result of the sinking of the mounting spaces 11, 12 in the ground, there is the advantage that the risk of accidents is reduced for the operating personnel of the press which may be caused by the large amount of transmitted energy.

Figure 3:
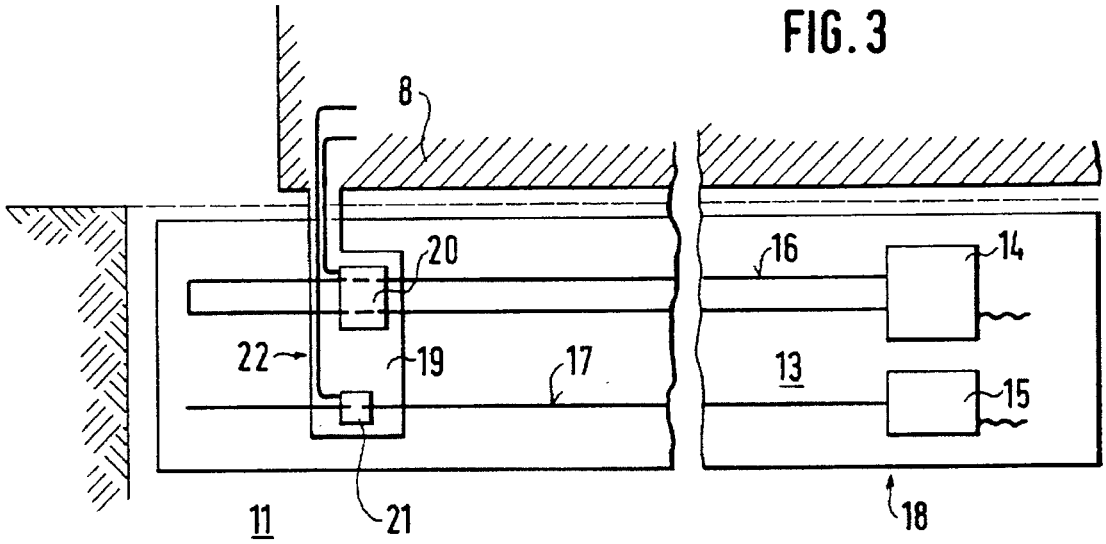
FIG. 3 is a sectional view along line III—III of FIG. 2.

In the mounting space 11, as shown more precisely in FIG. 3, on a side wall of the mounting space 11, a base plate 13 is fastened on which a transmitter 14 for energy is mounted as well as a first data coupler 15.

From the transmitter 14, an energy coupling loop 16 is guided on the base plate 13.

From the first data coupler 15, a first antenna 17 extends parallel to the longitudinal axis of the base plate 13.

The transmitter 14, the first data coupler 15, the energy coupling loop 16 and the first antenna 17 are fixedly mounted on the base plate 13 and, in the following, will therefore be called the stationary device designated generally by numeral 18. Likewise, the base plate 13 is fixedly mounted in the mounting space 11.

On the sliding table 8, another base plate 19 is arranged on which a second transmitter 20 for energy is fastened as well as a second antenna 21 for data.

In this case, the second transmitter 20 is constructed such that it has two openings through which the energy coupling loop 16 is guided. The second antenna 21 is arranged at the same level as the first antenna 17 on the base plate 13.

If the sliding table 8 is now moved in a linear manner, during the moving of the sliding table 8, energy can be transmitted to the sliding table, specifically from the transmitter 14 into the coupling loop 16 and, from there, in a no-contact manner to the second transmitter 20, from which the energy is forwarded by way of a line to the consuming devices on the sliding table 8.

The transmission of data takes place from the first data coupler 15 into the first antenna 17 and from there, in a no-contact manner, into the second antenna 21, from where the data are transmitted by way of at least one line to a data sink.

Naturally, the energy or data and signal transmission may also take place in the other direction, that is, also in a bidirectional manner.

Since, during the moving of the sliding table 8, the base plate 19, the second transmitter 20 as well as the second antenna 21 move along with the sliding table 8, in the following, the described arrangement will be called the movable device designated generally by numeral 22.

The stationary device 18 as well as the movable device 22 therefore represent the transmission system designated generally in FIG. 1 by numeral 3.

Figure 4:
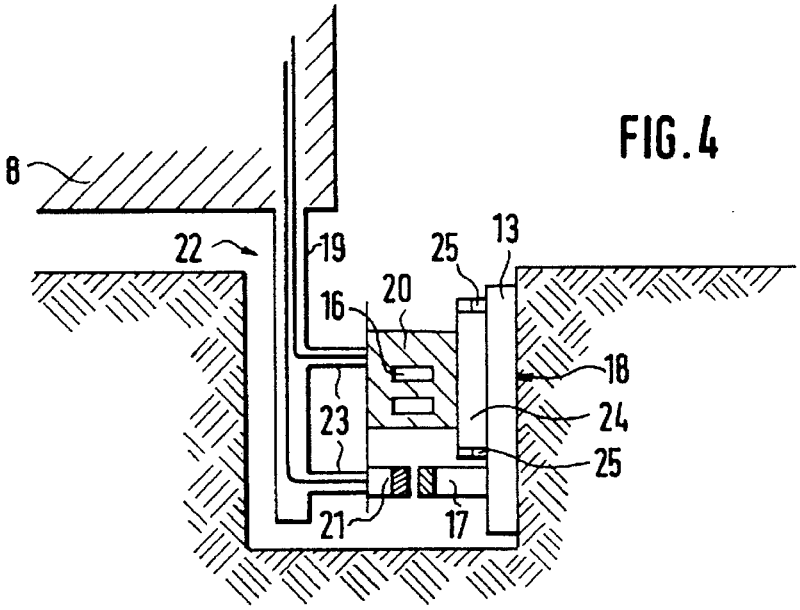
FIG. 4 is a sectional view along line IV—IV of FIG. 2.

In FIG. 4, particularly the openings in the second transmitter 20 are easily visible, with the energy coupling loop 16 being guided through the openings. Furthermore, the levels of the second antenna 21 and the first antenna 17 are seen to be the same.

The second transmitter 20 as well as the second antenna 21 are connected with the base plate 19 by way of connecting links which, in the illustrated embodiment, are constructed as pins 23. If the pins 23 are constructed to be adjustable lengthwise, the distance can be adjusted between the second transmitter 20 as well as the second antenna 21 and the base plate 19. As a result, in particular, tolerances can be compensated which occur because of the moving of the sliding table 8 on the rails so that, along the entire sliding path of the sliding table 8, a transmission of energy or data and signals is ensured which is free of disturbances.

This measure is also promoted by the fact that the second transmitter 20 is connected with an intermediate member 24, in which case the intermediate member 24 is guided in guides 25 which are mounted on the base plate 13 of the stationary device 18. As a result, a uniform and constant transmission of data, signals and energy is always ensured from the stationary device 18 to the movable device 22. Consequently, the movable device 22 is connected with the stationary device 18 by the pins 23, the second transmitter 20 as well as the guides 25. If the guide 25 is not used, it is possible that, during the acceleration and/or braking of the sliding table 8, the second antenna 21 starts to vibrate in such a manner that a data transmission which is free of disturbances is no longer possible. The same applies to the transmission of energy from the coupling loop 16 to the second transmitter 20.

Figure 5:
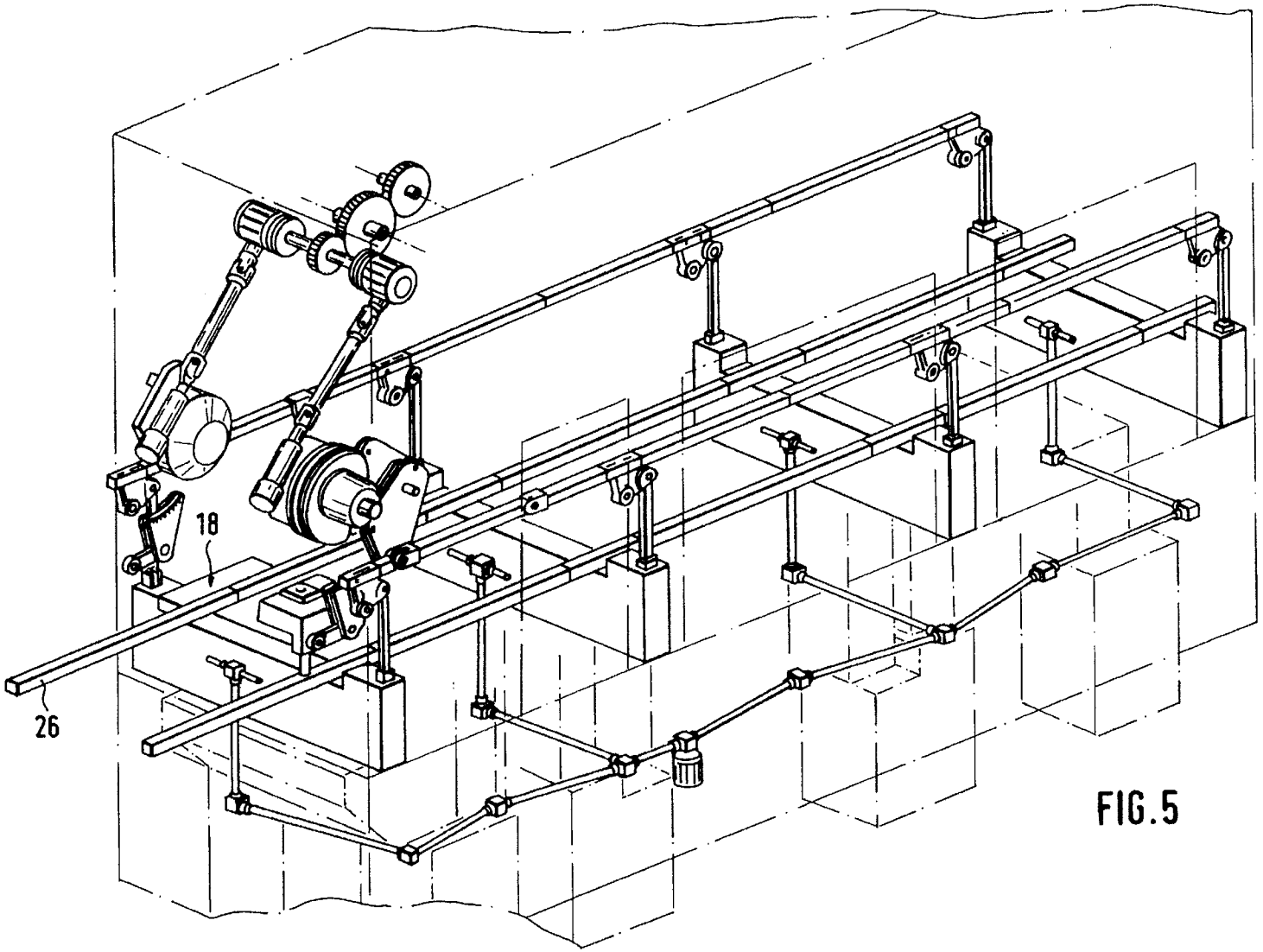
FIG. 5 is a schematic view of a transfer device of a metal-forming machine which is provided with the present invention.

In a transfer device of a press, as illustrated in FIG. 5, movements take place in the direction of several axles. If the axles are now driven discretely or if data sources are data sinks are arranged on the individual axles, the cabling expenditures will be extremely high. By using the process as well as the arrangement, as described in connection with FIGS. 1 to 4, the expenditures for producing connections between the drives and the sensors or actuators of the transfer device can be reduced considerably.

A stationary device 18, as described above in detail, is preferably arranged between the press stands of the known press. The movable device can then be arranged on a machine part which is movable relative to the stationary device 18 and which also carries out a linear movement with respect to the stationary device 18.

Advantageously, the stationary device 18 is arranged on at least one traverse with the metal-forming machine which extends transversely to the transfer direction.

Since, as mentioned above, a plurality of axles are moved on the transfer devices of metal-forming machines, it is only shown as an example in FIG. 5 how the stationary device 18 may, for example, be arranged on a cross traverse or on the press stand, while the movable device 22 (not visible here) which complements the stationary device 18 is mounted on a transfer rail 26.

Naturally, several of these arrangements may be arranged perpendicularly to one another or behind one another so that the transmission of data, signals and energy can take place to all axles of the transfer device.

Analogously to the above-described second embodiment, the process according to the present invention can also be used on feeding and removing devices for blanks on metal-forming machines. Since the basic construction of feeding and removing devices for blanks is largely similar to that of the transfer device, an embodiment need not be further described here.

In the case of both described embodiments, the transmission of energy may take place inductively while, in the case of the transmission of data and signals, in addition to the inductive transmission, a capacitive coupling is also possible. A precise description of the components required for the no-contact transmission is disclosed in German Published Patent Application DE 41 25 145.

Although the invention has been described and illustrated in detail, it is to be clearly understood that the same is by way of illustration and example, and is not to be taken by way of limitation. The spirit and scope of the present invention are to be limited only by the terms of the appended claims.

We claim:

1. A method of operating a press to transmit at least one of data, signals, and power, the method comprising the steps of:

arranging a sliding table of said press so as to be displaceable relative to a stationary device of said press;

providing the stationary device with a first transmitter, a coupling loop, a data coupler and a first antenna;

providing the sliding table with a second transmitter and a second antenna displaceable relative to said coupling loop and first antenna;

transmitting in a contactless manner at least one of said data, said signals and said power between the sliding table and the stationary device of said press.

2. The method according to claim 1, wherein said contactless transmitting step further comprises the step of inductively transmitting said power.

3. The method according to claim 1, wherein said contactless transmitting step further comprises the step of at least one of inductively and capacitively transmitting said data and said signals.

4. The method according to claim 1, wherein said contactless transmitting step further comprises the step of bidirectionally transmitting said at least one of said data, said signals, and said power between the sliding table and the stationary device.

5. A press arrangement for contactless transmission of at least one of data, signals, and power required by said press arrangement, comprising:

a press device having a sliding table;

a stationary device arranged in proximity to said sliding table, said sliding table being displaceable relative to said stationary device;

wherein said stationary device comprises a first base plate having mounted thereon a first transmitter, a first coupler, a coupling loop and a first antenna;

wherein said sliding table further comprises a second base plate having mounted thereon a second transmitter and a second antenna; and wherein said first and second base plates are linearly displaceable relative to one another.

6. The press arrangement according to claim 5, wherein the second transmitter is connected with an intermediate member which is guided in a guide on the first base plate of the stationary device.

7. The press arrangement according to claim 5, wherein at least one of the second transmitter and the second antenna is mounted by way of connecting members on the second base plate of the sliding table.

8. The press arrangement according to claim 7, wherein the connecting members are pins.

9. The press arrangement according to claim 5, wherein said stationary device is arranged below ground in the proximity of said sliding table.

10. The press arrangement according to claim 9, further comprising guide rails on which the sliding table is disposed in a movable manner, said stationary device being arranged in parallel to said rails below the ground surface, said second base plate being mounted on said sliding table.

11. The press arrangement according to claim 5, further comprising press stands of the press arrangement, said stationary device being arranged between said press stands.

12. The press arrangement according to claim 5, further comprising a transfer device of said press arrangement having a traverse support extending transversely to a transfer direction;

wherein said stationary device is arranged on the traverse support.

* * * * *